United States Patent [19]

Bigolin

[11] Patent Number: 4,825,565

[45] Date of Patent: May 2, 1989

[54] SOLE STRUCTURE FOR BICYCLIST SHOE

[75] Inventor: Giuseppe Bigolin, Rossano Veneto, Italy

[73] Assignee: Calzaturificio Duegi S.R.L., Cornuda, Italy

[21] Appl. No.: 91,382

[22] Filed: Aug. 31, 1987

[51] Int. Cl.[4] ..... A43B 5/14; A43B 7/06

[52] U.S. Cl. ..... 36/131; 36/3 B

[58] Field of Search ..... 36/131, 3 R, 3 B; 74/594.6

[56] References Cited

U.S. PATENT DOCUMENTS

| | | | |
|---|---|---|---|
| 3,256,621 | 6/1966 | Linton | 36/3 R |
| 4,100,685 | 7/1968 | Dassler | 36/3 B |
| 4,222,182 | 9/1980 | Sears | 36/131 |
| 4,547,983 | 10/1985 | Brandt | 36/131 |
| 4,590,689 | 5/1986 | Rosenberg | 36/3 B |
| 4,679,335 | 7/1987 | Berlese | 36/131 |

FOREIGN PATENT DOCUMENTS

| | | | |
|---|---|---|---|
| 0146761 | 7/1985 | European Pat. Off. | 36/131 |
| 3135346 | 5/1983 | Fed. Rep. of Germany | 36/131 |
| 344410 | 6/1904 | France | 36/3 B |
| 1305652 | 8/1962 | France | 36/3 B |
| 2427800 | 2/1980 | France | 36/131 |
| 2555417 | 5/1985 | France | 36/131 |

*Primary Examiner*—Steven N. Meyers
*Attorney, Agent, or Firm*—Nicholas L. Coch

[57] ABSTRACT

An improved sole structure for attachment to a shoe for bicyclists. The sole structure includes a conformed rigid body having in the front region a plurality of recessed seats each containing a fastener for attachment to a plate anchoring the sole structure to a bicycle pedal, and also includes in the plantar arch region a recessed seat containing a bolt fastened to a plate provided on the sole lower side, the plate being connected to a strap for attaching the sole structure securely onto a foot of a bicyclist. The sole structure provides channels extending rearwardly through the sole from a downward protruding frontal face for air ventilation of the foot of a cyclist, and includes a heel block attached to the sole lower surface rear portion to facilitate normal walking for the cyclist. The sole body upper face may include front and rear soft resilient cushions for improved support of the foot of the bicyclist. Preferably, the body structure includes an insole having a plurality of perforations located in flow communication with dual channels extending from a front inlet opening along the sole upper face to more effectively ventilate the cyclist's foot. A resilient layer such as organosiloxane gel may be provided in selected area portions of the insole.

16 Claims, 4 Drawing Sheets

FIG. 1
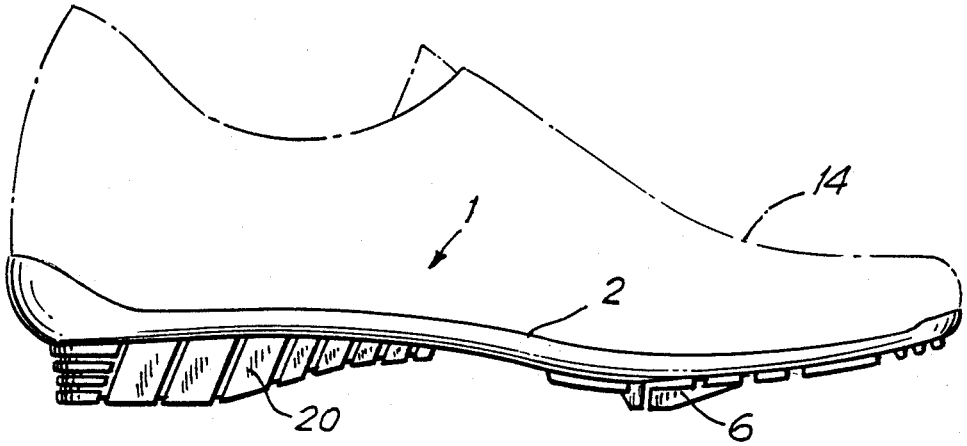
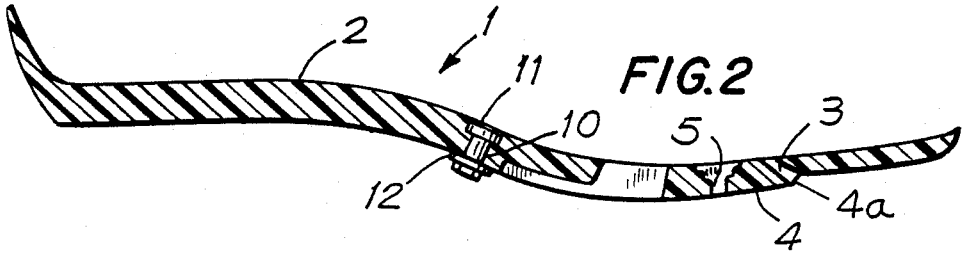
FIG. 2
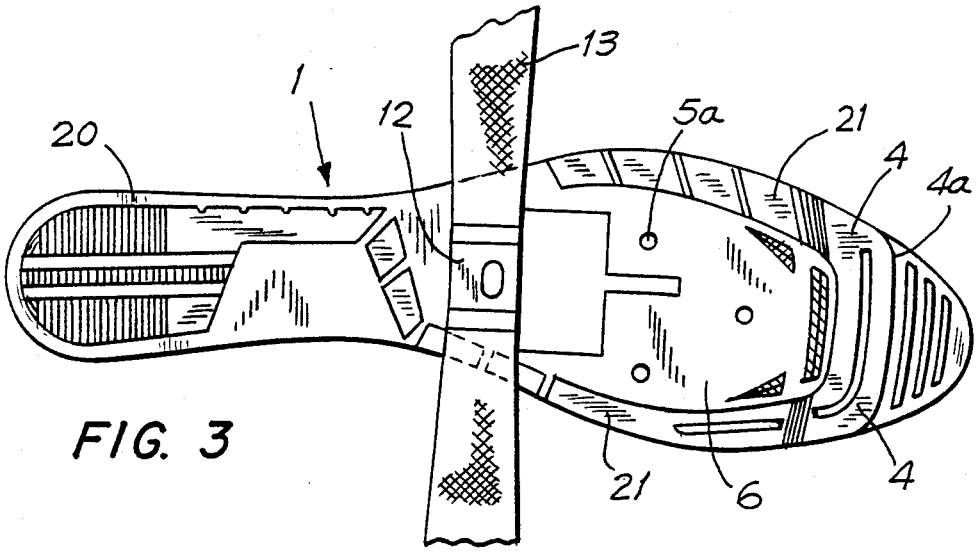
FIG. 3

SOLE STRUCTURE FOR BICYCLIST SHOE

BACKGROUND OF THE INVENTION

The present invention relates to an improved sole structure, and particularly to a sole structure designed for shoes for bicyclists and which provides improved support and ventilation for the foot of the bicyclist.

As is known from the prior art, the shoes which are customarily used by bicycle riders are at present manufactured with a solid sole structure made of a synthetic material, which generally results in substantial problems with regard to sweating, lack of ventilation and resilient support for the feet of a rider. Furthermore, another drawback found in the known type of shoes for bicyclists is the fact that, when using a pedal with "Lock" type attachment, the shoe is attached to the bicycle pedal only at the sole. For these reasons, detachment or disengagement can take place in some cases between the shoe uppers and the sole when the bicyclist exerts a strong pulling action with respect to the bicycle pedal.

Another drawback which can be ascribed to the ineffective solutions of the prior art is due to the fact that the shoe assumes a special shape particularly at the heel region, and it becomes extremely difficult for a bicyclist to walk normally because during walking, the region of the heel is in practice lowered. For this reason, walking by the bicycle rider is unnatural and uncomfortable.

SUMMARY OF THE INVENTION

The main object of the present invention is to eliminate the above-mentioned drawbacks by providing an improved sole structure for bicyclists' shoes which affords sufficient ventilation in the sole area to minimize perspiration of the foot of a rider, even when the sole structure is made of a rigid synthetic material which provides the desired characteristics of mechanical strength.

Another object of the invention is to provide a sole structure which transfers the traction forces imparted by the rider's foot directly onto the sole, even when using attachments in which the shoe sole is anchored directly to the bicycle pedal with a strap without the use of the traditional toe cage.

Another object is to provide a shoe sole structure which is capable of fully satisfying all the needs of the bicyclist and includes shock absorbing material located in selected areas of the sole, and includes an elevated heel block so a to afford comfortable walking when the cyclist is not on a bicycle.

A further object of the invention is to provide an improved shoe design in which the rigid sole structure is covered by a perforated insole having a resilient shock absorbing material incorporated therein.

Still another object is to provide an improved sole structure for a bicyclist's shoe of simplified construction and which, as a result of its specific structural characteristics, is able to offer improved comfort, reliability and safety during use by a cyclist.

The objects set forth above as well as others are achieved by an improved sole structure in accordance with the invention and particularly designed for bicyclists' shoes.

In a preferred embodiment of the invention, the contoured rigid sole structure is covered on its upper surface with an insole element which extends over the full length of the sole structure and is enclosed within the upper portion of a shoe. The insole contains a plurality of perforations which are spaced apart from each other and extend generally rearwardly along the sides of the insole from the front end to the heel area. The perforations are located above and in flow communication with dual channels formed in the front portion of the upper face of the rigid sole structure. The dual channels are flow connected to at least one slot or vent opening extending through the front portion of the sole structure, and are joined together near the heel portion of the sole structure to form a common channel which exits at the rear end of the sole structure. Thus, a major portion of the ventilation air which preferably enter dual slots provided at the front end of the sole structure can pass upwardly through the perforations to ventilate the foot of a rider. The remaining ventilation air exits at the rear heel area of the sole above a heel block attached to the sole structure lower side. The insole is also provided with a layer of resilient shock absorbing material such as a gel or rubber foam material located between dual layers of the insole, so as to provide adequate cushioning and support for the feet of a bicyclist.

Another useful embodiment of the invention relates to a sole structure comprising a substantially rigid body generally contoured to fit the bottom of a bicyclist's foot and containing a plurality of recesses each containing a seat, each said seat being adapted for receiving a fastener for attaching the sole body to a fastening plate adapted for being anchored to a bicycle pedal. The sole structure contains, at least in the front plantar region of the foot of a bicyclist, a plurality of holes which pass through the sole body and produce continuous air vent channels therein. The channels preferably extend rearwardly through the sole body from a downward protruding shoulder portion for air ventilating the foot of a rider. The sole body also includes in the plantar arch region, a recessed seat which contains a fastener attached to a clamping plate located on the body lower face, which plate is connected to a band or strap which embraces the foot of a bicyclist for mechanically anchoring the sole structure directly to the cyclist's foot. In addition, the lower face of the sole structure has a block provided in the region of the heel, such block having an increased thickness relative to the sole body. The sole body upper face includes a resilient cushioning material capable of anatomical conformation located at the front plantar portion of the foot rearwardly from the plurality of ventilating holes, and a rear cushioning material located at the rear heel portion of the foot. Each of the cushioning materials are firmly attached to the sole upper face and are shaped to provide resilient support for the foot of a bicyclist.

BRIEF DESCRIPTION OF DRAWINGS

Further characteristics and advantages of the present invention will become evident from the detailed description of an improved sole structure particularly designed for shoes for cyclists which is shown, by way of illustration but not limitation, in the accompanying drawings, in which:

FIG. 1 generally illustrates the sole structure of the invention shown in a side elevation view;

FIG. 2 shows the body of the sole structure in a longitudinal cross-sectional view;

FIG. 3 shows a bottom plan view of the sole structure of a shoe;

DESCRIPTION OF INVENTION

Figure 4:
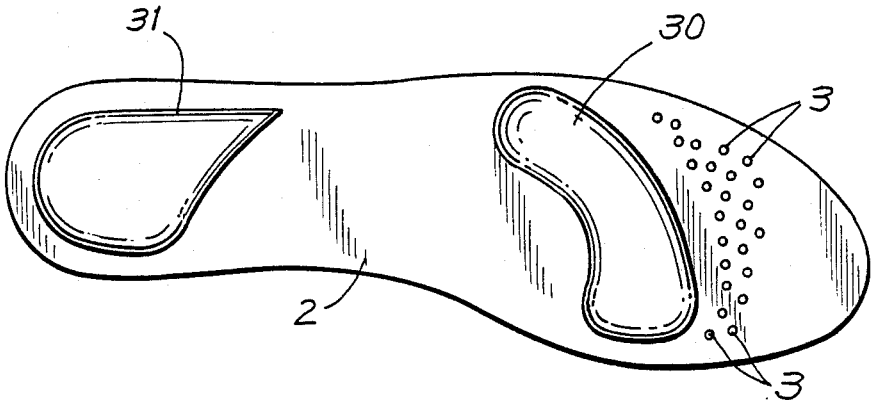
FIG. 4 shows a top plan view of the sole structure for one embodiment of the invention.

The invention will be described first with reference to FIGS. 1–5 of the drawings, in which the improved sole structure is indicated by the reference number 1 and comprises a contoured body 2 made of a substantially rigid synthetic material, such as polyvinylchloride (PVC), and which assumes a conforming shape to a shoe 14 so as to fit the lower part of the foot of a cyclist as well as providing an elevated portion in the region of the heel of the foot of the cyclist.

One important feature of the invention consists in the fact that at the front plantar region of the sole body 2 there are provided a plurality of holes 3 which pass through the sole 2 and each defines a continuous channel therein, which intersect the lower or outer face of the sole body 2 at the front end of a downwardly protruding zone 4 having a face portion 4a thereof. The continuous channels provided by the holes 3 are inclined towards the rear portion of the sole body 2 to facilitate the entrance of aeration air into the channels from the lower protruding face portion 4*a* during use by a cyclist. The flow of ventilating air toward the shoe sole adjacent the toes of a bicyclist's foot is conveyed into the channels due to the presence of the downwardly protruding zone 4, which preferably has a front face 4a located adjacent the inlet opening of the holes 3.

The sole body 2 contains a plurality of recessed seats 5, each of which contains a fastener 5*a* so as to anchor a fastening plate 6 onto the sole lower face and thereby attach the plate 6 to a pedal of a bicycle.

Another feature of the invention relates to the region of the sole plantar arch where a recessed seat 10 is provided for receiving a fastener such as bolt 11 that is attached to a clamping plate 12 provided on the sole body 2 lower face, with the clamping plate 12 being itself connected to an elongated transverse band or strap 13. The clamping plate 12 has the function of being connected to the strap 13 which is fastened around the foot of a bicyclist, thereby enabling the foot to be anchored directly to the sole structure 2. As a result, possible traction forces during the travel of the pedal are avoided which otherwise might result in undesired detachment between the shoe sole 2 and the upper part of the shoe 14 in cases where the sole structure is connected directly to the pedal. The strap 13 has the function of assuring a strong mechanical connection between the shoe sole structure 2 and the bicyclist's foot, thereby resulting in a more positive connection therebetween.

At the lower face or side of the sole body 2 in the region of the heel of a bicyclist, there is provided a heel block 20 formed of a resilient material which has an increased thickness, so as to provide more convenient and easier walking for the bicyclist. The heel block 20 adjoins a protruding rib 21 which practically surrounds the front planatar region of the sole, thus assuring improved strength for the sole structure 2.

Figure 5:
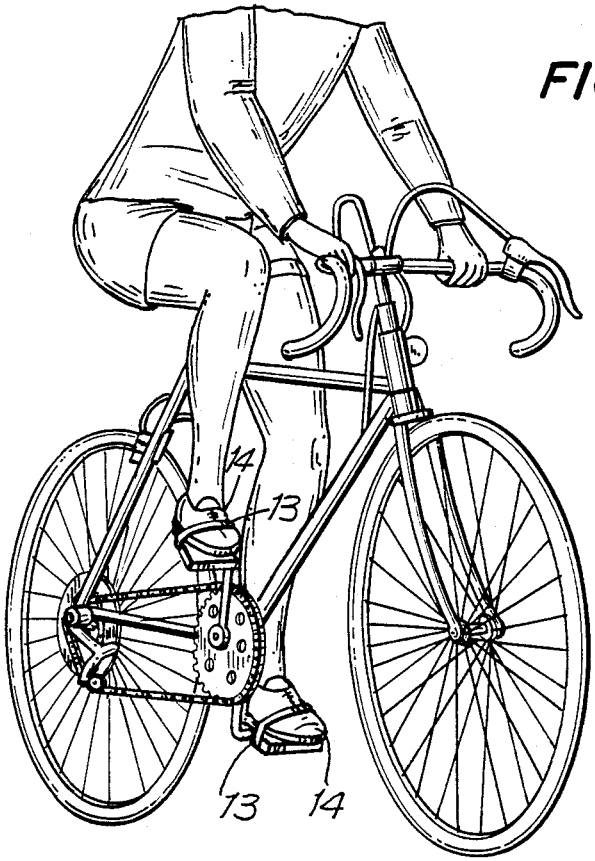
FIG. 5 illustrates shoes which employ the sole structure of the invention, during their use by a rider on a bicycle.

At the inner or upper face of the sole structure 1 as shown in FIG. 4, there is provided rearwardly from the holes 3 and continuous channels, a front cushion 30 formed of a soft resilient material such as silicone rubber, which creates a soft supporting region for the front ball portion of the cyclist's foot. A rear cushion 31 of a similar structural characteristics is also provided which is shaped so as to better support the heel of a bicyclist's foot. The upper face of sole structure 1 can be advantageously rigidly attached to the upper portion 14 of a shoe for a bicyclist, as is generally shown by FIG. 5.

Figure 6:
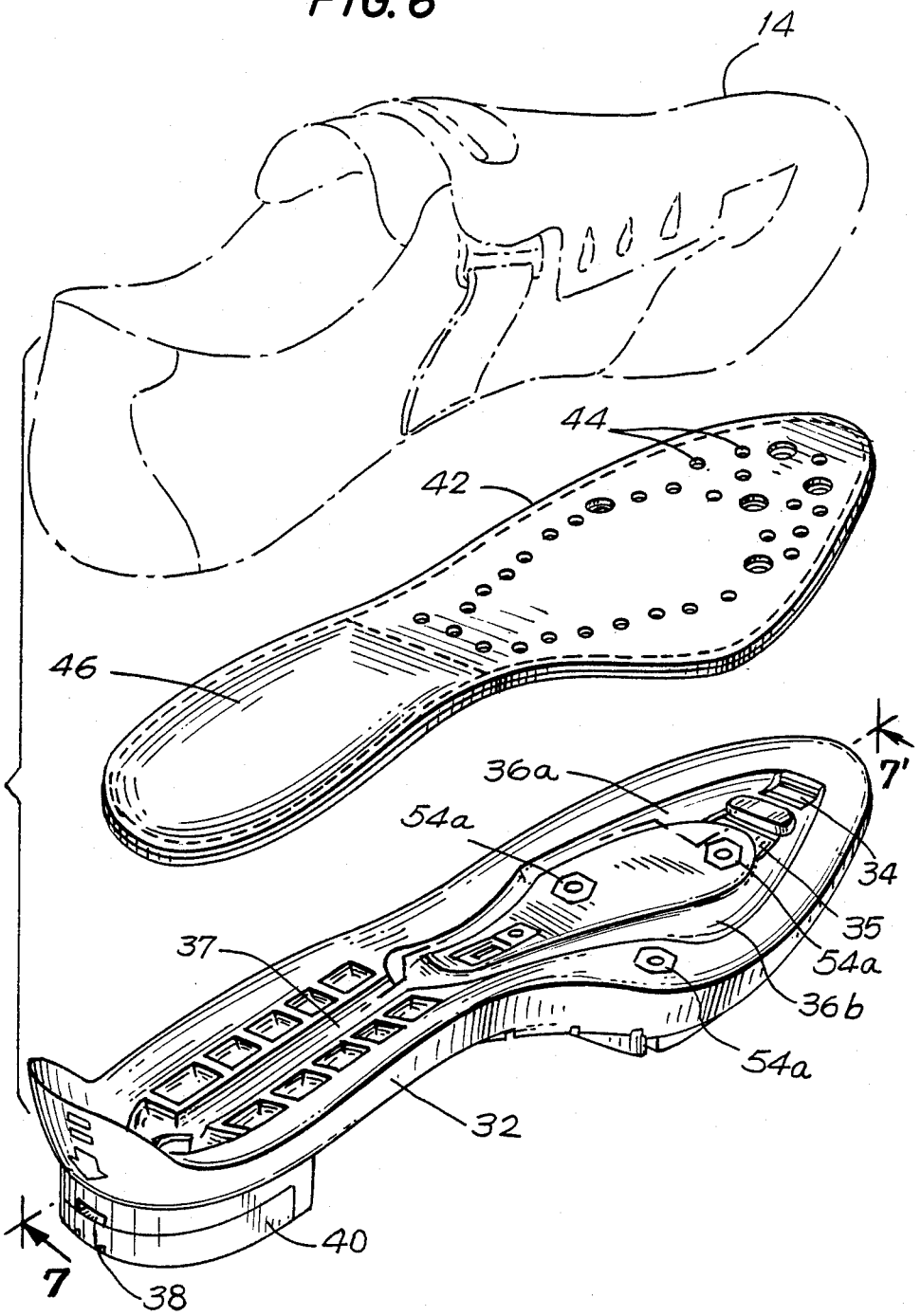
FIG. 6 shows a perspective exploded view of another embodiment of the invention, in which the sole structure has dual longitudinal channels provided in its upper face which is covered by an insole containing perforations located in flow communication with the longitudinal channels for ventilation air flow through the sole structure.
Figure 7:
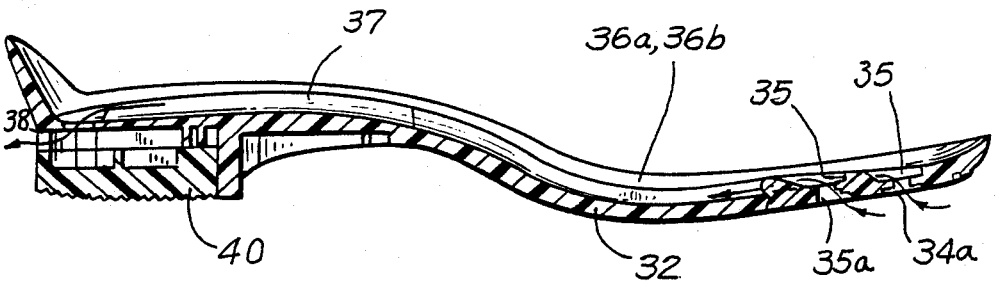
FIG. 7 shows a longitudinal cross-sectional view of the sole structure taken at line 7—7 of FIG. 6.
Figure 8:
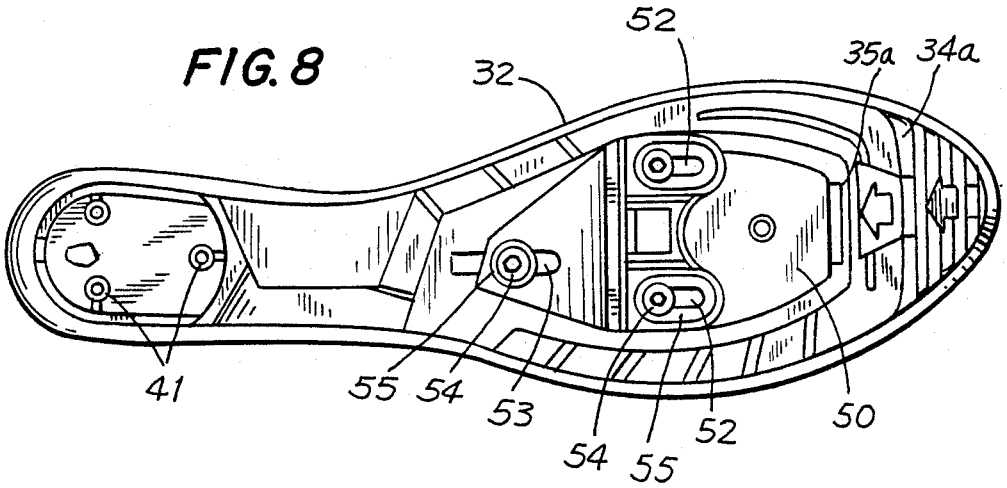
FIG. 8 shows a bottom plan view of the sole structure of the FIG. 6 embodiment.

The preferred embodiment of the invention is shown by FIGS. 6–8. The rigid shoe structure 32 is contoured similarly to sole body 2 and has provided near its front end two elongated transverse vent openings 34 and 35 which are substantially parallel to each other and extend through the sole structure 32 in a tandem relation. Each vent opening 34 and 35 is located adjacent a downwardly extending face 34*a* and 35*a*, each oriented so as to deflect ventilation air into the vent openings during use by a bicyclist. Both vent openings 34 and 35 are flow connected to dual channels 36*a* and 36*b* provided in the sole 32 upper face, which channels extend rearwardly near the side edges of the sole structure 32. The dual channels 36*a* and 36*b* are connected to a single channel 37, which exits through an opening 38 located in the sole 32 immediately above a heel block 40. The heel block 40 is attached to the sole structure 32 by a plurality of screw fasteners 41, which extend through the block 40 into the sole structure 32.

An insole 42 is provided attached to the upper face of sole structure 32, and is coextensive therewith. Insole 42 contains a plurality of perforations 44 which are spaced apart and located in vertical alignment and flow communication with elongated transverse vent openings 34 and 35 and with the dual channels 36*a* and 36*b* of the sole structure 32. Thus, when using a shoe employing sole structure 32, ventilation air is directed through openings 34 and 35 by action of the frontal faces 34*a* and 35*a* and into dual channels 36*a* and 36*b*. A major portion of the ventilation air flows upwardly through the perforations 44 provided in insole 42, and the remainder of the ventilation air flows through channel 37 and exits at the heel area through opening 38 in the sole structure 32.

The insole 42 preferably consists of two adjacent layers 42*a* and 42*b*, usually made of a flexible material such as leather. At the rear portion of insole 42, a pad 46 of resilient material such as foam rubber or gel is provided between the insole layers for absorption of energy forces produced by the cyclist during riding and walking activities. The pad 46 is preferably made of a soft organosiloxane gel material, such as that disclosed in U.S. Pat. No. 3,020,260, which is incorporated herein by reference to the extent needed for adequate disclosure. Also if desired, the resilient material can be provided in the front portion of the insole in such locations as to avoid obstructing the perforations 44. The thickness of the resilient material will be dependent upon the degree of cushioning desired, and will usually vary between about 0.050–0.125 inches.

To facilitate attachment of the sole structure 32 to a bicycle pedal, a fastening plate 50 is provided on the sole lower face. The location of plate 50, which is also adapted for attachment to a bicycle pedal, may be made longitudinally adjustable and is provided with two forward longitudinally oriented slots 52 and a rear slot 53. A screw fastener 54 having a washer 55 is provided in each slot, with a mating threaded nut 54a being embedded in the sole structure and located so as to avoid interference with the dual channels 36*a* and 36*b*. Thus, by loosening the threaded screws, the plate 50 can be moved longitudinally by the length of the slots 52, 53 and the screws then retightened in the new location.

From the above description it is evident how the invention achieves the purposes proposed. In particular, it is emphasized that there is provided a shaped sole structure for a bicyclist's shoe which conforms to the bicyclist's foot and makes it possible to assure good ventilation for the lower part of the bicyclist's foot, thus creating substantially increased comfort for the user. Furthermore, the presence of the strap 13 which effectively binds the user's foot to the sole structure, produces a stable condition between the sole 2 and the foot and accidental detachment between the sole structure 2 and the upper part of the shoe is prevented. The presence of the heel block 20 and the inventive sole body, in accordance with the invention provides a conforming shape which is closer to that of the ordinary shoe, thus facilitating comfortable walking by the cyclist. The use of resilient material on the inner face of the sole body and further by use of the insole as described above provides better support for a cyclist's foot, particularly at the front ball and rear heel portions.

In a preferred embodiment, the front and rear cushions are replaced by an insole containing a plurality of perforations. The sole structure is provided with twin inlet vent openings located in tandem relation at the sole front end, and in flow communication with dual channels extending rearwardly near the edges of the sole and terminate in an exit at the heel end of the sole to more adequately ventilate the foot of a user. Furthermore, the sole structure upper face is covered by the insole having perforations located in flow communication with the dual channels, and including a resilient cushioning material having anatomical conforming characteristics, located between the insole layers for providing improved cushioning for the cyclist's foot.

Although the best results for the sole structure are obtained with the materials described above, the materials used as well as the dimensions and contingent shapes may vary in accordance with what is required by the cyclist. Although the present invention has been disclosed broadly and in terms of a preferred embodiment, it is understood that modifications and variations can be made within the scope of the invention as defined by the following claims.

I claim:

1. An improved sole structure for attachment to shoes for bicyclists, comprising an elongated body generally contoured to contact the bottom of a bicyclist's foot, said body containing in a plantar front region a plurality of holes which extend through said body to produce continuous channels for air flow ventilation for a foot of a bicyclist, wherein said channels intersect the lower surface of said body at a frontal face of a downwardly protruding surface and are inclined towards the rear portion of said body.

2. An improved sole structure according to claim 1, wherein said body includes in a plantar arch region a recessed seat containing a fastener which is attached to a fastening plate located on the body lower face, said fastener plate being connected to a strap which holds in positive engagement the foot of a bicyclist to assure a mechanical connection between the sole structure and the foot.

3. An improved sole structure according to claim 2, wherein said fastening plate contains two forward located longitudinal slots and a rear slot, each said slot having a threaded fastener provided in the slot, so that the fastening plate is longitudinally adjustable relative to the sole structure.

4. An improved sole structure according to claim 1, wherein said body lower face includes a heel block provided in a rear region corresponding to the heel of a bicyclist, said heel block having increased thickness relative to the sole body and being removably attached to the sole body.

5. An improved sole structure according to claim 4, wherein said body lower face includes an outer ribbing extending forward from the adjoining heel block and covering substantially the edges of the front region of the body lower face.

6. An improved sole structure according to claim 1, wherein said body is rigidly attached at its upper face to the upper portion of a shoe to be worn by a cyclist.

7. An improved sole structure according to claim 1, including an insole element located above and coextensive with the upper face of said body, said insole containing a plurality of perforations vertically aligned with the outlets of said continuous channels, wherein said body contains dual channels formed in the body upper face, said channels each extending from at least one front opening provided through the body downwardly extending surface rearwardly near side edges of said body to an exit opening, the perforations in said insole being located in flow communication with said dual channels.

8. An improved sole structure according to claim 10 wherein said dual channels are each connected to twin transverse inlet openings extending through the body in tandem relation, each said openings being located adjacent the frontal face of the downwardly projecting surface near the body forward end.

9. An improved sole structure according to claim 7, wherein said dual channels are each connected to a single channel which exits at the heel portion of said body.

10. An improved sole structure according to claim 7, wherein said insole consists of two coextensive layers joined together at their perimeter and having a resilient material provided therebetween.

11. An improved sole structure according to claim 10, wherein said resilient material is a layer of organo-siloxane gel having a thickness of 0.040–0.125 inch.

12. An improved sole structure according to claim 16, wherein said layer of gel material is provided in the heel area of the insole.

13. An improved sole structure attached to a shoe for bicyclists, said sole structure comprising:

an elongated substantially rigid body generating contoured to contact the bottom of a bicyclist's foot, said body having an upper face containing a plurality of recesses each containing a seat, each said recess being adapted for receiving a fastener for attaching said body to a fastening plate located on the body lower face and adapted for being anchored to a pedal of a bicycle, said body containing in the plantar front region a plurality of holes which extend through the body and intersect the body lower face at a frontal face of a downwardly protruding zone to produce continuous channels, said channels being inclined rearwardly from said protruding zone face so as to air ventilate the foot of a bicyclist, said body including in the plantar arch region a recessed seat containing a fastener attached to a fastener plate located on the body lower face, said fastener plate being connected to a strap which holds in positive engagement the foot of a bicyclist so as to assure a mechanical connection between the sole structure and the foot of the bicyclist, said body lower face including a heel block provided in a rear region corresponding to the heel of a bicyclist, said heel block being removably attached to the sole body.

14. An improved sole structure for attachment to a shoe for bicyclists, said sole comprising:

an elongated substantially rigid body generally contoured to contact the bottom of a bicyclist's foot, said body having an upper face having a plurality of recesses each containing a seat, each of said recesses being adapted for receiving a fastener for attaching said body to a fastening plate located on the body lower side for anchoring to a pedal of a bicycle, said body including in the plantar front region dual openings connected to dual channels extending rearwardly along opposite edges of the sole body; said body including in a plantar arch region a recessed seat containing a fastener attached to a plate located on the body lower face, said plate being connected to a strap which holds in a positive engagement the foot of a bicyclist so as to assure a mechanical connection between the sole structure and the foot of the cyclist; and an insole located above and coextensive with the upper face of said body, said insole consisting of two coextensive layers joined together at their periphery and having a resilient layer of organosiloxane gel provided therebetween, said insole containing a plurality of perforations vertically aligned with said dual channels formed in the upper face of said body, whereby ventilation air enters at the front end of said body and passes through the dual channels and perforations in the insole to ventilate the foot of the bicyclist.

15. An improved sole structure for attachment to shoes for bicyclists, comprising an elongated body generally contoured to contact the bottom of a bicyclist's foot, said body containing in a plantar front region a plurality of holes which extend through said body to produce continuous channels for air flow ventilation for a foot of a bicyclist, wherein said body has an inner face and includes on the inner face a front cushion disposed to correspond with the front plantar region of the foot of a rider, and a rear cushion located corresponding with the region of the heel of a rider, said cushions each being made of a resilient material having anatomical conformation.

16. An improved sole structure according to claim 15, wherein said cushions are made of silicone rubber.

* * * * *